United States Patent [19]

Osawa et al.

[11] Patent Number: 4,912,007

[45] Date of Patent: Mar. 27, 1990

[54] IMAGE FORMING METHOD USING TONER OF PH 2.5–6.5

[75] Inventors: Izumi Osawa; Kenji Masaki, both of Osaka, Japan

[73] Assignee: Minolta Camera Kabushiki Kaisha, Osaka, Japan

[21] Appl. No.: 219,992

[22] Filed: Jul. 15, 1988

[30] Foreign Application Priority Data

Jul. 18, 1987 [JP] Japan ..... 62-179680

[51] Int. Cl.[4] ..... G03G 13/14; G03G 13/22

[52] U.S. Cl. ..... 430/126; 430/58; 430/66

[58] Field of Search ..... 430/58, 66, 126

[56] References Cited

U.S. PATENT DOCUMENTS

| | | | |
|---|---|---|---|
| 4,743,522 | 5/1988 | Iino et al. | 430/58 |
| 4,749,636 | 6/1988 | Iino et al. | 430/58 |
| 4,801,515 | 1/1989 | Iino et al. | 430/66 |

*Primary Examiner*—Roland E. Martin

*Attorney, Agent, or Firm*—Wenderoth, Lind & Ponack

[57] ABSTRACT

An image forming method wherein an electrostatic latent image formed on a photosensitive member having an organic plasma polymerized layer formed on the surface of the member is developed by using a toner having a pH of about 2.5 to 6.5. By this method, a sharp and clear image can be obtained over a long period of time.

4 Claims, 3 Drawing Sheets

IMAGE FORMING METHOD USING TONER OF PH 2.5–6.5

BACKGROUND OF THE INVENTION

1. Field of the Invention

The present invention relates to an image forming method for a copying apparatus or printer employing an electrophotographic method, and more particularly to a method for developing with a toner an electrostatic latent image formed on a photosensitive member.

2. Description of the Prior Arts

In order to perform a copying operation by using a copying apparatus or the like, firstly formed on a photosensitive member is an electrostatic latent image having a pattern corresponding to a document's image. Thereafter, the latent image is made visible to form a toner image with a developer which contains toner, and then, the toner image is transferred onto a transfer material.

Further, in an electrophotographic printer such as a laser beam printer or the like, an electrostatic latent image formed by scanning an output content onto a photosensitive member with a semiconductive laser light is made visible by the same manner as mentioned above.

Conventionally, inorganic materials such as Se, CdS, ZnO or the like are employed for a photosensitive member for use in such a copying apparatus, printer and the like. Further, the use of organic materials for a photosensitive member has been increasing recently.

Of these photosensitive members, amorphous selenium photosensitive members have some problems with respect to heat resistance, spectral sensitivity and dark decay. In order to overcome these problems, arsenic is doped into a selenium layer or a selenium-tellurium layer is laminated on the selenium layer. As a result, the amorphous selenium photosensitive members have the highest photosensitivity in spectral luminous efficiency of all the members and members comprising a selenium layer having a selenium-tellurium layer laminated thereon have the highest sensitivity in long wavelength light which is required for a printer using semiconductive laser light as a light source.

On the other hand, organic photosensitive members are excellent from the standpoints of sensitivity, chargeability and cost for manufacture.

Materials used in the construction of organic photosensitive members are, in general, photoconductive materials which produce an electric charge such as, for example, phthalocyanine series pigments, azo series pigments, perillene series pigments and the like, electrical charge transporting materials such as, for example, triphenylmethanes, triphenylamines, hydrazones, styryl compounds, pyrazolines, oxazoles, oxydiazoles, and the like, binding materials for dispersion coating such as, for example, polyester, polyvinyl butyral, polycarbonate, polyarylate, phenoxy, styrene-acryl, and other resins.

Repeated use of these types of photosensitive members, however, gives rise to problems of image defects, white streaks, and the like. These problems arise because the surface hardness of the organic photosensitive member roughly falls within the range from the 5B to B levels of the JIS standards for pencil lead hardness although the selenium-arsenic and selenium-tellurium photosensitive members have the surface hardness of about H, thus the surface of the photosensitive member is readily damaged due to the friction which is generated when the member comes into contact with the transfer paper, cleaning components, developer, and the like. Another cause of such problems is the harsh surface contact made when paper jams occur and the resultant reversion to manual operation required to remedy the malfunction. Furthermore, damage to the surface of the photosensitive member results in a marked reduction in the surface potential of the member.

Moreover, the selenium members have a disadvantage that they are harmful to the human body. Specifically, selenium and arsenic which are scraped or vaporized by a heat in the copying apparatus are very harmful to the human body, the harmfulness of said substances being a matter for concern.

The inventors of the present invention have proposed in U.S. Ser. No. 069,516 filed July 2, 1987 (Group Art Unit: 156) a photosensitive member having a hard surface protective layer formed on the surface of a photosensitive member in order to overcome these problems. More specifically, U.S. Ser. No. 069,516 discloses a photosensitive member having an overcoat layer of amorphous hydrocarbon containing halogen atoms formed on the photosensitive member, said overcoat layer being formed by using hydrocarbon gases and halogen compound gases as a starting material and by causing a glow discharge under a vacuum.

However, the photosensitive member having the surface protective layer is low in moisture resistance when repeatedly used, causing a problem of producing an image drift during the development.

SUMMARY OF THE INVENTION

The main object of the present invention is to provide an image forming method capable of obtaining a sharp and clear image over a long period of time.

Another object of the invention is to provide an image forming method capable of obtaining a sharp and clear image under a high moisture.

These and other objects of the present invention can be accomplished by providing an image forming method wherein an electrostatic latent image formed on a photosensitive member having an organic plasma polymerized layer formed on the surface of the member is developed by using a toner having a pH of about 2.5 to 6.5.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
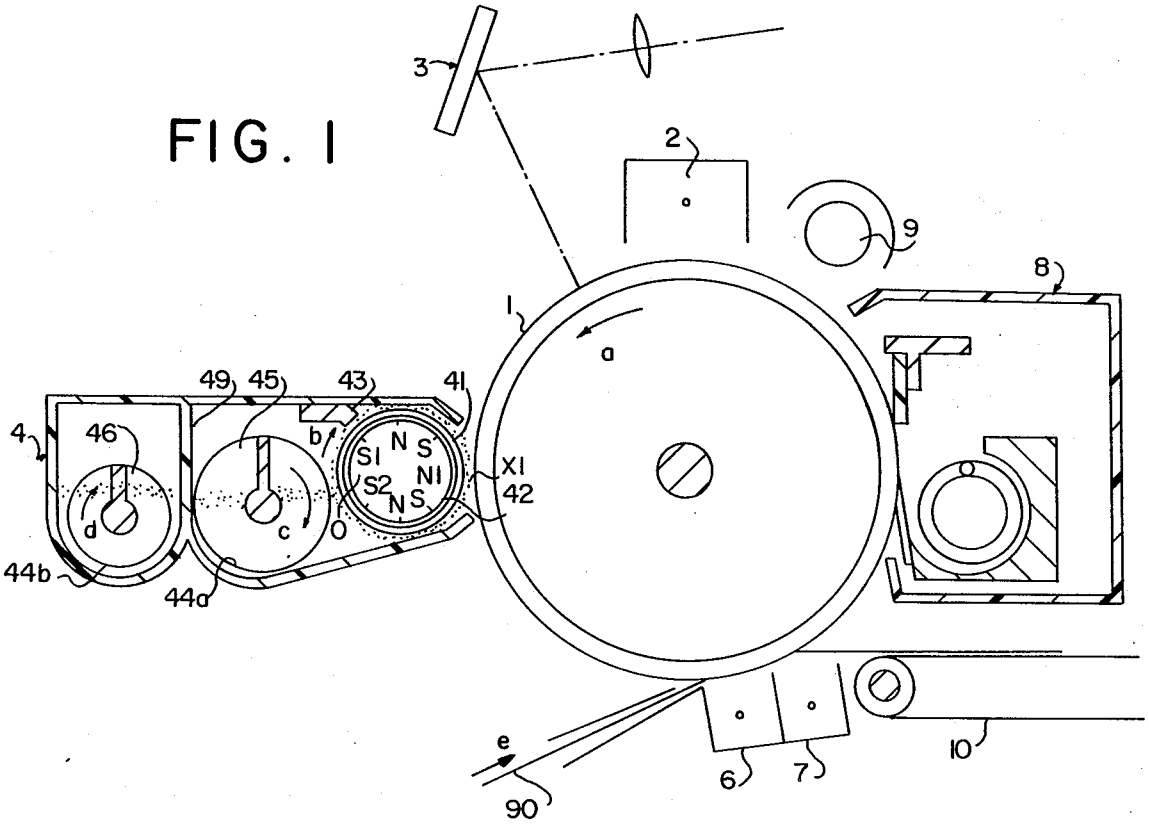
FIG. 1 is a sectional view schematically showing a developing unit for use in a method according to the present invention.
Figure 2:
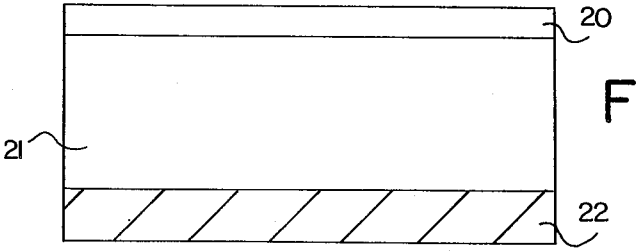
FIG. 2 is a diagram showing a photosensitive member for use in the method according to the present invention.

FIG. 1 shows a schematic arrangement of an electrophotographic apparatus for use in a method according to the present invention.

A photosensitive drum 1 having an electrostatic latent image carrier layer laid on its outer periphery is rotatable in the direction of an arrow a. Around the drum 1, there are disposed a corona charger 2, an exposure unit 3 of the slit exposure type, a developing unit 4, a transfer charger 6, a copying sheet separation charger 7, a residual toner cleaning unit 8 of the blade type, and a residual charge eraser lamp 9.

The developing unit 4 has a developing sleeve 41 opposed to the photosensitive drum 1, and a magnet roller 42 housed in the sleeve 41 and having N and S seven poles along its outer periphery. The rear portion of the magnet roller 41 away from the drum 1 has no magnetism or a weak magnetic force. An agitating roller 45 and a screw roller 46 are arranged in the rear of the developing sleeve 41 and are drivingly rotatable in the direction of arrows c, d, respectively. The developer composed of magnetic toner and non-magnetic carrier is circulated by the rollers 45 and 46 and the screw roller 46 is replenished with the toner from a bottle not shown. The developer is supplied to the developing sleeve 41, transported in the direction of arrow b owing to the rotation of the sleeve 41 itself in the same direction while being attracted in the form of a brush to the outer peripheral sleeve surface and brought into rubbing contact with the drum surface at a developing station for development. The developer thereafter moves off the sleeve surface at the rear portion of the magnet roller 42 where the roller 42 has low or no magnetism, and is returned to the agitating roller 45.

As is well known, a copying operation is carried out in the following sequence. A certain amount of electric charge is first applied by the corona charger 2 on the surface of the photosensitive durm 1 which is in rotation in the direction of arrow a, and an electrostatic latent image is produced on the drum surface by light irradiation from the exposure unit 3. Then, the developing unit 4 is operated, and a toner is supplied to the electrostatic latent image in a developing zone Xl, so that the latent image is developed into a visible image.

The toner image thus formed is transported to a portion opposite to the transfer charger 6 as the photosensitive drum 1 is rotated, so that it is transferred onto a sheet 90 delivered in the direction of arrow e.

The sheet 90 onto which the toner image is transferred is transported on a conveyor belt 10 to a fixing unit not shown, in which the toner image is fixed to the sheet 90, which is then discharged.

The photosensitive drum 1 which has passed through the transfer zone is subjected to scraping of any residual toner by the cleaning unit 8, being then subjected to light irradiation by the eraser lamp 9 for residual charge erasing. The drum 1 is now ready for a next cycle of copying.

The aforesaid photosensitive drum 1 comprises on a substrate 22 composed of aluminum a photosensitive layer 21 and an overcoat layer 20 formed of an organic plasma polymerized layer.

A photosensitive layer 21 is provided on a conductive substrate 22 thereby forming an organic photosensitive member, nd the interior construction of said photosensitive layer 21 may be a functionally separated construction having a laminated charge producing layer and a charge transporting layer, a binder-type construction having a charge producing material and charge transporting material dispersed throughout a binding material, or other construction.

The overcoat layer 20 is formed by means of a glow discharge process. The overcoat layer 20 is formed at a thickness of 0.01 to 5 microns, preferably 0.05 to 2 microns, and ideally 0.1 to 1 microns.

The pH of the toner used in the present invention is about 2.5 to 6.5, preferably about 3.5 to 6.0, and ideally about 4.0 to 5.7.

According to the present invention, the toner having the pH of less than 2.5 is too strong in acid, promoting the deterioration of the cleaning member which is provided for removing the residual toner after transfer. Consequently, cleaning may not sufficiently be performed. On the other hand, if the pH of the toner is more than 6.5, the toner is too weak in acid, resulting in that the surface hydrophilication is promoted to cause the image drift.

The pH of the toner can be adjusted by selecting materials for manufacturing toner. Examples of useful materials are resins, carbon black, dyes, charge controlling agents, wax, or the like. According to the present invention, the pH of the manufactured toner is more important than that of each material. Further, the toner need to have the pH of about 2.5 to 6.5 based on the measurement described below regardless of the types of toner.

A method for measuring the pH of toner will be explained hereinbelow.

5 g of sample materials are measured by a beaker of 500 ml, to which 150 ml of hydrogen is added. Thus obtained solution is boiled for five minutes, and thereafter, cooled down to a room temperature. Subsequently, this solution is set to a centrifuge (2000 rpm) for about three minutes for separation. The top clear part of the resultant solution is thrown away, only leaving precipitates.

This precipitates are put into the beaker for measuring the pH thereof with a glass electrode pH device according to the JIS Z 8802 which is one of methods for measuring the pH.

The measurement is carried out three times with the precipitates stirred by the stirring stick in order to adhere the precipitates to the surroundings of the electrodes. This operation is repeatedly performed until the measured values obtained by a series of three times measurement fall within a range of less than 0.1.

The present invention will be described with reference to the following examples.

EXAMPLES 1 to 10 and Comparative Examples 1 to 4

As shown in Table 1 described below, ten different photosensitive members were obtained in Examples 1 to 10 by forming an overcoat layer $\alpha$ or $\beta$ on a photosensitive layer a, b, c, d, e or f. An image forming operation is performed to the obtained ten members by using nine types of toner A to I, the result of which is shown in Table 1. Further, four different photosensitive members were obtained in Comparative Examples 1 to 4 by the same manner as mentioned above, the result of which is shown in Table 2. Methods for manufacturing toners A to I, photosensitive layers a to f and overcoat layers $\alpha$ and $\beta$ are explained hereinbelow.

Adjustment of Toner

[Toner A which is charged to a positive polarity]

| | |
|---|---|
| stylene-n-buthyl methacrylate resin (a softening temperature: 132° C. a glass transition temperature: 60° C.) | 100 parts by weight |
| carbon black (MA #8 manufactured by Mitsubishi Kasei Co., Ltd.) | 5 parts by weight |
| nigrosine dye | 3 parts by weight |

-continued

| | |
|---|---|
| (Bontron N-01 manufactured by Orient Chemical Industries Ltd.) | |

The above-mentioned materials were fully mixed in a ball mill, and then, were kneaded on three rolls which were heated to a temperature of 140° C. The mixed materials, after leaving to cool down, were roughly pulverized by a feather mill, and further pulverized by a jet mill. Subsequently, the resultant materials were subjected to a wind-force scale device for classification, obtaining a fine particle having an average diameter of 13 microns. When measured based on the aforesaid measuring method, the obtained toner A was found to have the pH of 6.5.

It is to be noted here that the average diameter of toner was measured by the use of Coulter Counter Model TA-II (manufactured by Coulter Electronics Inc.), by which a relative weight distribution varying from diameters was measured with an aperture tube of 100 microns.

[Toner B which is charged to a positive polarity]

The toner B was obtained by the same manner as that of toner A except for employing carbon black in an amount of 7 parts by weight, said toner B having the pH of 5.7.

[Toner C which is charged to a positive polarity]

The toner C was obtained by the same manner as that of toner A except for employing carbon black of RAVEN 3200 manufactured by Columbian Carbon Japan Co., Ltd in an amount of 7 parts by weight, said toner C having the pH of 6.9.

[Toner D which is charged to a negative polarity]

| | |
|---|---|
| polyester resin (a softening temperature: 130° C. a glass transition temperature: 60° C.) | 100 parts by weight |
| carbon black (MA #8 manufactured by Mitsubishi Kasei Co., Ltd.) | 5 parts by weight |
| spiron black TRH (manufactured by Hodogaya Chemical Co., Ltd.) | 3 parts by weight |

The above-mentioned materials were treated by the same manner as that of toner A for obtaining the toner D having the pH of 4.4.

[Toner E which is charged to a positive polarity]

The toner E was obtained by the same manner as that of toner A except for employing carbon black of MA #8 manufactured by Mitsubishi Kasei Co., Ltd. in an amount of 6 parts by weight, said toner E having the pH of 6.0.

[Toner F which is charged to a positive polarity]

The toner F was obtained by the same manner as that of toner A except for admixing two types of carbon black as mentioned below, said toner F having the pH of 4.0.

| | |
|---|---|
| carbon black (#2400B manufactured by Mitsubishi Kasei Co., Ltd.) | 2 parts by weight |
| carbon black (MA #8 manufactured by Mitsubishi Kasei Co., Ltd.) | 3 parts by weight |

[Toner G which is charged to a positive polarity]

The toner G was obtained by the same manner as that of toner A except for employing carbon black of #2350 manufactured by Mitsubishi Kasei Co., Ltd. in an amount of 5 parts by weight, said toner G having the pH of 3.5.

[Toner H which is charged to a positive polarity]

The toner H was obtained by the same manner as that of toner A except for employing carbon black of #2400B manufactured by Mitsubishi Kasei Co., Ltd. in an amount of 7 parts by weight, said toner H having the pH of 2.5.

[Toner I which is charged to a positive polarity]

The toner I was obtained by the same manner as that of toner A except for employing carbon black of #2350 manufactured by Mitsubishi Kasei Co., Ltd. in an amount of 8 parts by weight, said toner I having the pH of 2.2.

Manufacture of Photosensitive Layers

[Manufacture of Organic Photosensitive Layer A]

A fluid mixture of 1 g of chlorodian blue (CDB) as a disazo pigment, 1 g of polyester resin (Toyobo Co., LTD., V-200), and 100 g of cyclohexanone were dispersed in a sand grinder for 13 hours. A cylindrical aluminum substrate measuring 80×330 mm was dipped in the fluid dispersion so as to be coated with a 0.3 micron thick film after drying, said film was then dried to form the charge generating layer.

Next, 1 g of 4-diethylaminobenzaldehyde diphenylhydrazone (DEH) and 1 g of polycarbonate (Teijin Kasei Co., K-1300) were dissolved in 6 g of THF, and the solution was applied over the charge generating layer so as to form a layer of 15 micron thickness after drying, said application was then dried forming a charge transporting layer and an organic photosensitive layer a is thus obtained.

[Manufacture of Organic Photosensitive Layer b]

A fluid mixture of 25 parts by weight of specific -type copper phthalocyanine (Toyo Ink Manufacturing Co, LTD.,), 50 parts acrylmelamine thermosetting resin (Dainippon Ink and Chemicals, Inc., a mixture of A-405 and Super Bekkamin J-8200), 25 parts 4-diethylaminobenzaldehyde diphenylhydrazone, and 500 parts organic solvent (a mixture of 7 parts xylene and 3 parts butanol) was pulverized and dispersed in a ball mill for 10 hours. A cylindrical aluminum substrate measuring 80 mm in diameter by 330 mm in length was dipped in this fluid dispersion so as to be coated with a film having a thickness of 15 microns after drying, said film was then baked 1 hour at 150° C., whereby the organic photosensitive layer b was obtained.

[Manufacture of Organic Photosensitive Layer c]

A fluid dispersion of 2 parts dis-azo compound as shown in a formula Ia described later, 1 part polyester resin (Toyobo Co., V-500), and 100 parts methyl ethyl ketone, was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 3,000 angstroms, thereby forming a charge producing layer.

Next, a coating comprising 10 parts hydrazone compound as shown by a formula Ib described later and 10 parts polycarbonate resin (Teijin Kasei Co., K-1300) dissolved in 80 parts tetrahydrofuran was applied to the charge generating layer so as to form a layer having a thickness of 20 microns after drying, said layer then being dried to form a charge transporting layer, thereby forming the organic photosensitive layer c.

[Manufacture of Organic Photosensitive Layer d]

A fluid dispersion of 2 parts dis-azo compound as shown by a formula IIa described later, 1 part polyester resin (Toyobo Co., V-500), and 100 parts methyl ethyl ketone was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 2,500 angstroms, thereby forming a charge generating layer.

Next, a coating comprising 10 parts stilbene compound as shown by a formula IIb described later and 10 parts polyarylate resin (Unichika Co., U-4000) dissolved in 85 parts tetrahydrofuran was applied to the charge generating layer so as to form a layer having a thickness of 20 microns after drying, said layer then being dried to form a charge transporting layer, thereby forming the organic photosensitive layer d.

[Manufacture of Organic Photosensitive Layer e]

A fluid dispersion of 2 parts dis-azo compound as shown by a formula IIIa described later, 1 part polyester resin (Toyobo Co., V-500), and 100 parts methyl ethyl ketone was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 3,000 angstroms, thereby forming a charge generating layer.

Next, a coating comprising 10 parts stilbene compound as shown by a formula IIIb described later and 10 parts methyl methacrylate resin (Mitsubishi Rayon, BR-85) dissolved in 80 parts tetrahydrofuran was applied to the charge generating layer so as to form a layer having a thickness of 20 microns after drying, said layer then being dried to form a charge transporting layer, thereby forming the organic photosensitive layer e.

[Manufacture of Organic Photosensitive Layer f]

Titanylphthalocyanine (TiOPc) underwent vacuum deposition using a heat resistance process at a boat temperature of approximately 400° to 500° C. in a vacuum of $10^{-4}$ to $10^{-6}$ torr, with the resulting TiOPc deposition film having a thickness of 2,500 angstroms forming charge generating layer.

Then, 1 part p,p-bisdiethylaminotetraphenylbutadiene, having the chemical structure shown by a formula IV, and 1 part polycarbonate (Teijin Kasei Co., K-1300) were dissolved in 6 parts THF, and a coating of the solution was applied to the aforesaid charge generating layer so as to form a film having a thickness of 15 microns after drying, said film then being dried to form a charge transporting layer, thereby forming an organic photosensitive layer f.

These photosensitive layers are used for negative charging except for the photosensitive layer b which is used for positive charging. Further, the photosensitive layer f is exposed with long wavelength light, while others are exposed with a normal light.

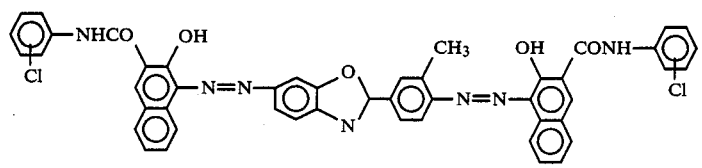

Ia

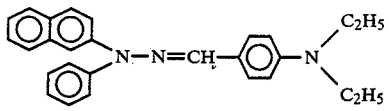

Ib

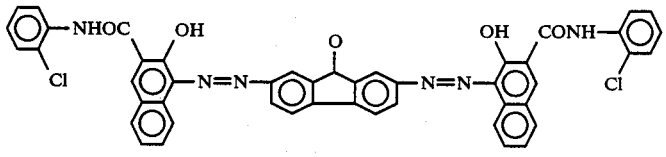

IIa

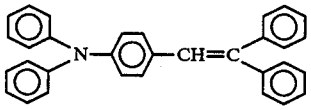

IIb

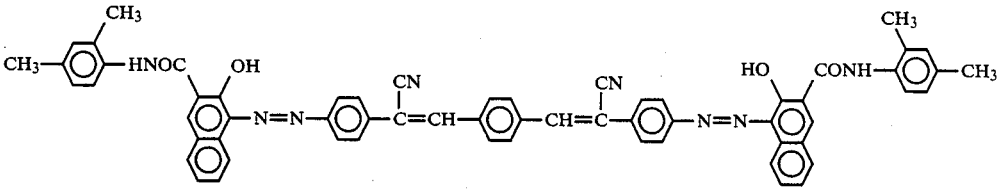

IIIa

-continued

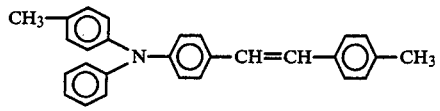

IIIb

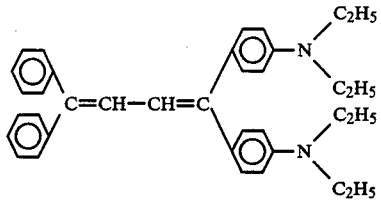

IV

Manufacture of Organic Plasma Polymerized Layer (Overcoat Layer)

A glow discharge decomposition apparatus for forming the overcoat layer mentioned below will be explained hereinafter with reference to FIGS. 3 and 4.

Figure 3:
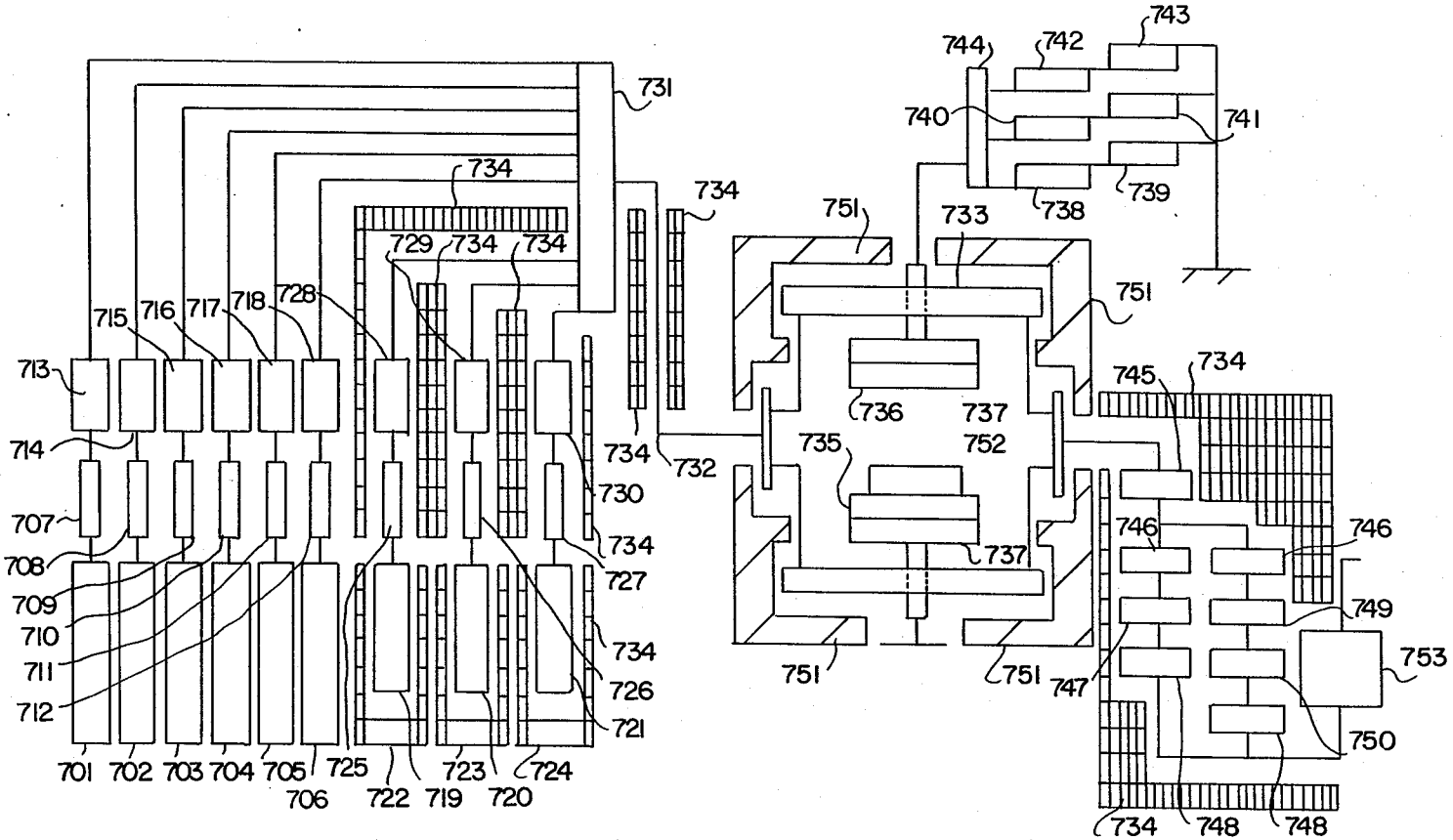
FIGS. 3 and 4 are diagrams showing apparatus for preparing photosensitive members shown in FIG. 2.

FIG. 3 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a exception of the interior arrangement of the reactor 833. The numerals shown by 700 order in FIG. 3 are replaced by the numerals at 800 order in FIG. 4. With reference to FIG. 3, the reactor 833 is internally provided with a hollow cylindrical electrically conductive substrate 852 serving also as the grounded electrode 735 of FIG. 3 and with an electrode heater 837 inside thereof. A power application electrode 836, similarly in the form of a hollow cylinder, is provided around the substrate 852 and surrounded by an electrode heater 837. The conductive substrate 852 is rotatable about its own axis by motor from outside.

[Overcoat Layer α]

Figure 4:
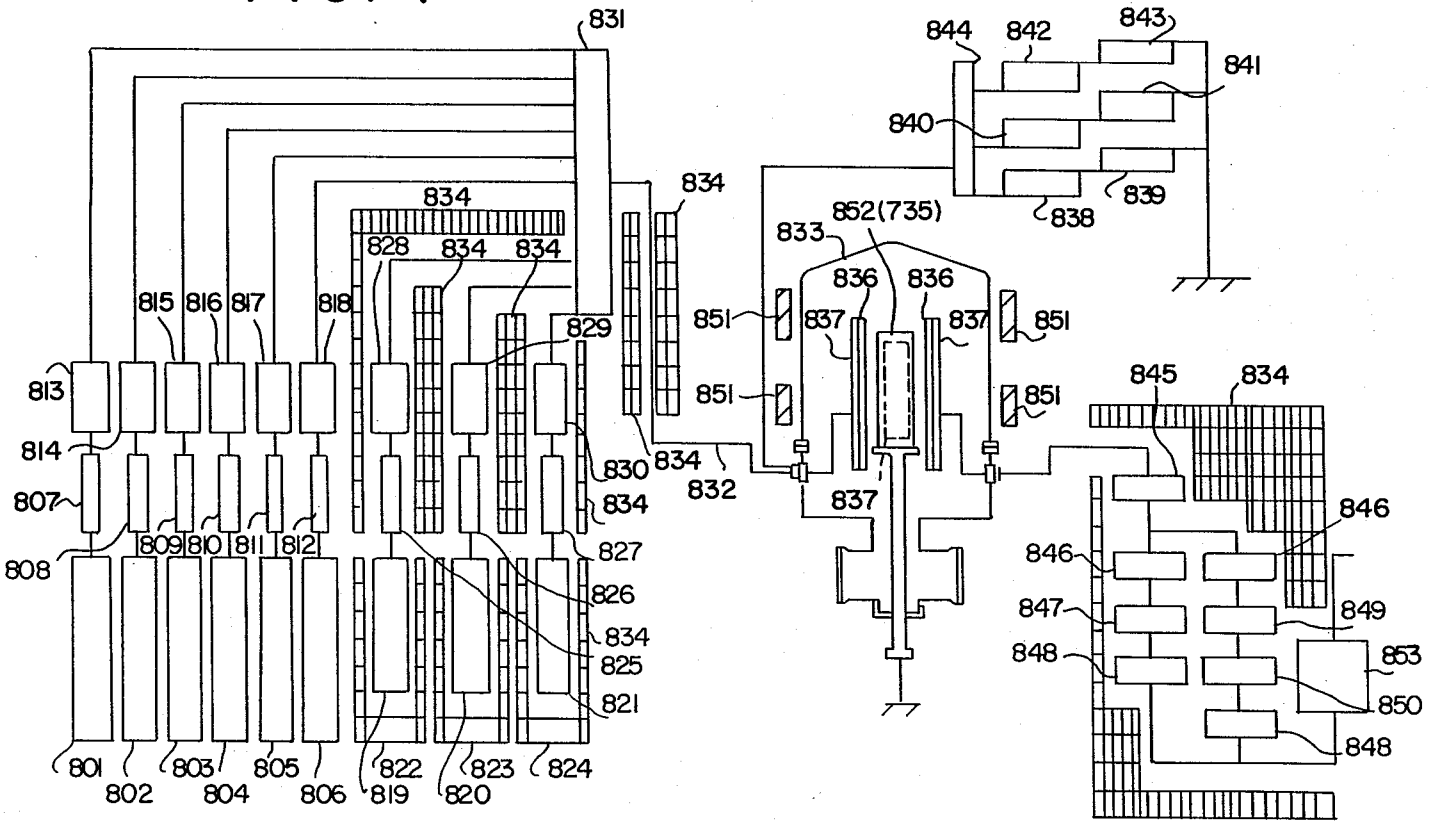

Using a glow discharge decomposition apparatus shown in FIG. 4, an overcoat layer of the present invention for a photosensitive member was prepared.

First, the interior of the reactor 733 was evacuated to a high vacuum of about $10^{-6}$ torr, and the first, second and third regulator valves 707, 708 and 709 were thereafter opened to introduce hydrogen gas from the first tank 701, butadiene gas from the second tank 702 and perfluoropropane gas from the third tank 703 into the first flow controller 713, the second flow controller 714 and the third flow controller 715 respectively at an output pressure of 1.0 kg/cm$^2$. The dials on the flow controllers were adjusted to supply the hydrogen gas at a flow rate of 300 sccm, the butadiene gas at 60 sccm and the perfluoropropane gas at 10 sccm to the reactor 733 through the main pipe 732 via the intermediate mixer 731. After the flows of the gases were stabilized, the internal pressure of the reactor 733 was adjusted to 0.7 torr by the low-frequency power matching device 740 and to a d.c. power source 743 via a low-pass filter 742. Power of one of the different frequencies, for example, a low frequency of 1 KHz to 1 MHz, or a high frequency of 13.56 MHz and the like is applicable to the electrode 736 by way of a connection selecting switch 744. Direct electrical power may also be additionally applied.

The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor.

Although FIG. 3 shows that the substrate 752 is fixed to the grounded electrode 735, the substrate may be attached to the power application electrode 736, or to both the electrodes.

FIG. 4 shows another type of apparatus for preparing the photosensitive member of the invention. This apparatus has the same construction as the apparatus of FIG. 3 with the pressure control valve 745. On the other hand, the organic photosensitive layer was used as the substrate 752, said substrate being preheated to a temperature of 50° C. for 15 minutes before the introduction of these gases. With the gas flow rates and the pressure in stabilized state, 150-watt power with a frequency of 40 KHz was applied to the power application electrode 736 from the low-frequency power source 741 preconnected thereto by the selecting switch 744 to conduct plasma polymerization for 2 minutes, forming an a-C layer, 0.2 microns in thickness, as an overcoat layer.

Thereafter, the regulator valves for hydrogen gas was closed, whereupon the vacuum was broken and the photosensitive member having the overcoat layer α formed on the photosensitive layer was removed.

[Overcoat Layer β]

An overcoat layer β was manufactured in substantially the same manner as was the layer o with the exception of employing the following starting materials.

| | |
|---|---|
| propylene gas | 60 sccm |
| carbon dioxide gas | 10 sccm |
| helium gas | 100 sccm |

Evaluation

The photosensitive members having photosensitive layers a, c, d and e are negatively charged and exposed with a normal light. Therefore, these members were installed in a Minolta Model EP 470Z copy machine (hereinafter referred to as a copy machine X) to carry out the running test. The photosensitive members having the photosensitive layer b are positively charged and exposed with a normal light, so that the running test for these members were performed by employing a copy machine which was a modification of EP 470Z copy machine for giving a positive polarity (hereinafter referred to as a copy machine Y). Moreover, the photosensitive members having the photosensitive layer f, which were negatively charged and exposed with long wavelength light, were installed in a copy machine which was a modification of EP 470Z copy machine such that the optical system was modified to polygon mirror scanner using a semiconductive laser light (hereinafter referred to as a copy machine Z).

A predetermined number of copies (A4 size) were continuously made under environmental conditions of 35° C. temperature and 80% humidity. The results of these evaluations are shown in Table 1. In the table, the [E] mark indicates no evidence of image drift detected under conditions of 35° C. and 80% relative humidity; the [G] mark indicates partial image drift under identical conditions; the [B] mark indicates image drift throughout the entire copy under identical conditions.

As apparent from Table 1, clear and sharp images were obtained according to the present invention after 300,000 copies were made.

On the other hand, when copies were made using a toner having the pH which is outside the range of the present invention, image drift was observed even after making a few copies due to the reduced moisture resistance.

TABLE 1

| Examples | 1 | 2 | 3 | 4 | 5 | 6 | 7 | 8 | 9 | 10 |
|---|---|---|---|---|---|---|---|---|---|---|
| photosensitive layer | a | b | c | d | e | f | a | c | d | e |
| overcoat layer | α | α | α | β | β | β | β | β | α | α |

TABLE 1-continued

| Examples | 1 | 2 | 3 | 4 | 5 | 6 | 7 | 8 | 9 | 10 |
|---|---|---|---|---|---|---|---|---|---|---|
| toner | A | D | B | A | A | B | E | F | G | H |
| pH | 6.5 | 4.4 | 5.7 | 6.5 | 6.5 | 5.7 | 6.0 | 4.0 | 3.5 | 2.5 |
| copy machine | X | Y | X | X | X | Z | X | X | X | X |
| result after making 0 copy | E | E | E | E | E | E | E | E | E | E |
| $10 \times 10^3$ copies | E | E | E | E | E | E | E | E | E | E |
| $50 \times 10^3$ copies | E | E | E | E | E | E | E | E | E | E |
| $100 \times 10^3$ copies | E | E | E | E | E | E | E | E | E | E |
| $250 \times 10^3$ copies | E | E | E | E | E | E | E | E | E | E |
| $300 \times 10^3$ copies | E | E | E | E | E | E | E | E | E | E |
| $350 \times 10^3$ copies | G | E | E | E | G | E | E | E | E | G |
| $400 \times 10^3$ copies | G | E | E | G | G | E | G | E | G | G |

TABLE 2

| Comparitive Examples | 1 | 2 | 3 | 4 |
|---|---|---|---|---|
| photosensitive layer | a | f | f | c |
| overcoat layer | α | β | — | α |
| toner | C | C | B | I |
| pH | 6.9 | 6.9 | 5.7 | 2.2 |
| copy machine | X | Z | Z | X |
| result after making 0 copy | E | E | E | E |
| $10 \times 10^3$ copies | G | E | E | E |
| $50 \times 10^3$ copies | B | G | —*1 | E |
| $100 \times 10^3$ copies | B | B | — | —*2 |
| $250 \times 10^3$ copies | B | B | — | — |
| $300 \times 10^3$ copies | B | B | — | — |
| $350 \times 10^3$ copies | B | B | — | — |
| $400 \times 10^3$ copies | B | B | — | — |

*1: The thickness of the photosensitive layer in Comparitive Examples 3 was reduced to half of the initial thickness after 20,000 copies were made, failing to obtain an image having a preferable density.

*2: In Comparitive Example 4, the cleaning operation was not efficiently performed due to the abrasion of the cleaning blade after 65,000 copies were made, failing to achieve a preferable image.

What is claimed is:

1. An image forming method comprising:

a first step of forming an electrostatic latent image on a photosensitive member having an organic plasma polymerized layer at its outermost surface;

a second step of developing said latent image with toner particles having a pH of about 2.5 to 6.5; and a third step of transferring the developed image to a transfer material.

2. An image forming method as claimed in claim 1, wherein the toner particles used in the second step preferably have a pH of about 3.5 to about 6.0.

3. An image forming method comprising:

a first step of forming an electrostatic latent image on a photosensitive member comprising an electrically conductive substrate, an organic photosensitive layer formed on said substrate and an organic plasma polymerized layer formed on said photosensitive layer as an overcoat layer;

a second step of developing said latent image with toner particles having a pH of about 2.5 to 6.5; and a third step of transferring the developed image to a transfer material.

4. An image forming method as claimed in claim 3, wherein the toner particles used in the second step preferably have a pH of about 3.5 to about 6.0.

* * * * *